US008499776B2

(12) United States Patent
Ban

(10) Patent No.: US 8,499,776 B2
(45) Date of Patent: Aug. 6, 2013

(54) STICK

(75) Inventor: Toshiki Ban, Aichi (JP)

(73) Assignee: NCC Co., Ltd., Aichi (JP)

( * ) Notice: Subject to any disclaimer, the term of this patent is extended or adjusted under 35 U.S.C. 154(b) by 0 days.

(21) Appl. No.: 13/393,323

(22) PCT Filed: Jul. 26, 2010

(86) PCT No.: PCT/JP2010/062502

§ 371 (c)(1),
(2), (4) Date: Feb. 29, 2012

(87) PCT Pub. No.: WO2011/030627

PCT Pub. Date: Mar. 17, 2011

(65) Prior Publication Data

US 2012/0160286 A1 Jun. 28, 2012

(30) Foreign Application Priority Data

Sep. 14, 2009 (JP) ..... 2009-211482

(51) Int. Cl.
*A45B 3/12* (2006.01)
*A45B 7/00* (2006.01)

(52) U.S. Cl.
USPC ..... 135/75; 135/65; 135/82; 403/109.1; 248/188.5; 248/188.8

(58) Field of Classification Search
USPC ..... 135/65–66, 69, 75, 82, 86; 248/188.1, 248/188.5, 188.8; 403/109.1–109.4, 109.7
See application file for complete search history.

(56) References Cited

U.S. PATENT DOCUMENTS

| | | | | | |
|---|---|---|---|---|---|
| 1,924,957 | A * | 8/1933 | Orr | 446/81 |
| 2,183,975 | A * | 12/1939 | Savage | 135/66 |
| 2,630,128 | A * | 3/1953 | Slater | 135/69 |
| 3,040,757 | A * | 6/1962 | Smith | 135/86 |
| 5,573,025 | A * | 11/1996 | Atlas | 135/65 |
| 6,595,226 | B2 * | 7/2003 | Uemura | 135/75 |
| 2001/0027802 | A1 * | 10/2001 | McGrath | 135/65 |
| 2006/0090783 | A1 | 5/2006 | King-Fai | |
| 2007/0089770 | A1 * | 4/2007 | Park | 135/82 |

FOREIGN PATENT DOCUMENTS

| | | | |
|---|---|---|---|
| JP | 63-74544 | U | 5/1988 |
| JP | 4-1753 | U | 1/1992 |
| JP | 3057695 | U | 6/1999 |
| JP | 2000-175716 | A | 6/2000 |
| JP | 2006-136602 | A | 6/2006 |
| JP | 2007014395 | A * | 1/2007 |
| JP | 2008-516704 | A | 5/2008 |

* cited by examiner

*Primary Examiner* — Winnie Yip
(74) *Attorney, Agent, or Firm* — McDermott Will & Emery LLP

(57) ABSTRACT

A stick that is excellent in shock absorption and is also excellent in stability is provided.
A stick body is provided with a telescopic extension pipe formed by fitting an outer tube and an inner tube together in a nesting manner. Inside the extension pipe, a velocity-dependent damper that damps the relative sliding movement between the outer tube and the inner tube, and a compression coil spring that concentrically fits onto the damper and urges the extension pipe so as to be extended are connected in parallel. According to such a stick, the shock transmitted to the hand can be mitigated as the compression coil spring contracts upon landing. Also, since the damper suppresses unwanted vibration of the extension pipe, the length of the stick quickly becomes stable after landing, allowing the user to keep stable balance with the stick.

2 Claims, 10 Drawing Sheets

STICK

CROSS REFERENCE TO PRIOR APPLICATIONS

This application is a U.S. National Phase application under 35 U.S.C. §371 of International Application No. PCT/JP2010/062502, filed on Jul. 26, 2010 and claims benefit of priority to Japanese Patent Application No. 2009-211482, filed on Sep. 14, 2009. The International Application was published in Japanese on Mar. 17, 2011 as WO 2011/030627 A1 under PCT Article 21(2). All these applications are herein incorporated by reference.

The present invention relates to a stick used for aiding in everyday walking, mountain climbing, mountain hiking, skiing, and so on.

BACKGROUND

In the related art, there has been proposed a stick with a built-in compression coil spring to prevent the hand gripping the stick from getting hurt by the shock when landing on the ground. An example of the stick is proposed in Japanese Patent No. 4017598. As shown in FIG. 10, such a stick 1*c* includes a stick body 2 having a telescopic extension structure. Upon landing, a compression coil spring 20 built in the stick body 2 contracts so as to absorb shock, thereby mitigating the shock transmitted to a grip 3.

SUMMARY OF THE INVENTION

However, the above-mentioned stick 1*c* with the built-in compression coil spring 20 has a drawback in that because the compression coil spring 20 continues to vibrate for a while after contracting upon landing, the length of the stick does not become stable after landing, making it difficult for the user to keep his or her balance. For this reason, although widely adopted for sticks designed for mountain climbing or mountain hiking uses where the emphasis is on shock absorption, this type of stick is not very widely adopted for sticks designed for uses by the elderly or physically handicapped where the emphasis is on stability.

The present invention has been made in view of the above-mentioned circumstances, and accordingly its object is to provide a stick that is excellent in shock absorption and is also excellent in stability.

According to the present invention, there is provided a stick including a stick body of a rod-like shape that is provided with a grip. The stick body includes an extension pipe of a telescopic type formed by fitting an outer tube and an inner tube together in a nesting manner. Inside the extension pipe, a compression coil spring that urges the extension pipe so as to be extended, and a damper having velocity dependence that damps a relative sliding movement between the outer tube and the inner tube are connected. The damper includes a cylinder coupled to one of the outer tube and the inner tube, and a piston rod coupled to the other one of the outer tube and the inner tube. The compression coil spring concentrically fits onto the damper, and the compression coil spring and the damper are connected in parallel with respect to the outer tube and the inner tube. According to the above-mentioned configuration, as in the configuration according to the related art, when a load is applied to the stick upon landing, the compression coil spring contracts to absorb shock. Then, according to this configuration, as the damper connected in parallel to the compression coil spring suppresses vibration of the contracted compression coil spring, the length of the stick becomes stable immediately after landing.

The velocity-dependant damper according to the present invention increases its damping force depending on the relative speed of an object to which the damper is connected. Oil dampers, gas-type dampers, electromagnetic dampers, and the like can be given as examples of such a velocity-dependant damper.

According to the present invention, a configuration is proposed in which the cylinder and the piston rod each include a flange that protrudes outwards, and the compression coil spring concentrically fits onto the damper, and abuts against the flange of the cylinder at its one end and abuts against the flange of the piston rod at the other end. According to the above-mentioned configuration, inside the long and narrow stick body, the compression coil spring and the damper can be connected in parallel without much difficulty with respect to the outer tube and the inner tube. Thus, the stick according to the present invention can be implemented in the same size as existing sticks.

As another aspect of the present invention, there is proposed a stick including a stick body of a rod-like shape that is provided with a grip. The stick body includes an extension pipe of a telescopic type formed by fitting an outer tube and an inner tube together in a nesting manner. Inside the extension pipe, a gas-type damper having velocity dependence is provided, the gas-type damper urging the extension pipe so as to be extended by a gas pressure and exerting a damping action with respect to a relative sliding movement between the outer tube and the inner tube. According to the above-mentioned configuration, when a load is applied to the stick upon landing, the gas-type damper contracts while resisting the load to thereby absorb shock. Owing to its own damping action, the gas-type damper remains stable without vibrating even after contracting. Thus, according to this configuration as well, the length of the stick becomes stable immediately after landing. Moreover, according to this configuration, the gas-type damper can double as a spring. Therefore, by omitting a spring, it is possible to achieve downsizing and weight reduction of the extension pipe.

As the gas-type damper, for example, it is possible to adopt a configuration in which the gas-type damper includes a cylinder coupled to one of the outer tube and the inner tube, and a piston rod coupled to the other one of the outer tube and the inner tube, the cylinder is provided with a gas chamber filled with compression gas, an oil chamber filled with oil, and a free piston that separates the gas chamber and the oil chamber, and the piston rod penetrates an end of the cylinder and is coupled to a piston held in the oil chamber, and is urged so as to project from the cylinder by a gas pressure of the compression gas, the piston rod having has its travelling speed with respect to the cylinder reduced by viscosity of the oil in the oil chamber.

Also, according to the present invention, there is proposed a stick used to aid in everyday walking, in which a shoe made of rubber is provided at a bottom end of the stick body, the shoe being formed by integrally coupling a fitting part that tightly fits to the stick body, and a grounding part having a substantially circular bottom surface provided with a non-slip shape, by a flexible neck part. According to the above-mentioned configuration, as the neck part of the shoe bends, the bottom surface of the grounding part can be kept in contact with the ground even in a state where the stick is tilted. Thus, the tip of the stick can be securely held on the ground until the stick is released after being placed on the ground.

Also, according to the present invention, a configuration is proposed in which a part or entirety of the outer tube is made of a transparent material to make the inside of the outer tube visible from the outside. According to the above-mentioned configuration, by letting the user see the inside of the extension pipe, it is possible to demonstrate excellent shock absorption and stability of the stick to the user.

As described above, with the stick according to the present invention, as the extension pipe contracts upon landing, the shock on landing is absorbed, and also the length of the extension pipe quickly becomes stable after landing. Thus, the stick combines excellent shock absorption with excellent stability. Therefore, when the present invention is adopted for sticks designed for the elderly or physically handicapped, the hand of the elderly or physically handicapped can be protected from the shock upon landing while ensuring sufficient stability. Also, when the present invention is adopted for sticks used for mountain climbing or mountain hiking, stability can be improved without compromising shock absorption. The same effect can be obtained when the present invention is adopted for ski sticks (poles).

BRIEF DESCRIPTION OF THE DRAWINGS

FIG. 2(*a*) shows the extended state of an extension pipe 6, and FIG. 2(*b*) shows the contracted state of the extension pipe 6.

FIG. 4(*a*) shows the extended state of the extension pipe 6, and FIG. 4(*b*) shows the contracted state of the extension pipe 6.

FIG. 8(*a*) shows the extended state of a piston rod 23, and FIG. 8(*b*) shows the contracted state of the piston rod 23.

FIG. 9(*a*) shows the extended state of the extension pipe 6, and FIG. 9(*b*) shows the contracted state of the extension pipe 6.

FIG. 10(*a*) shows the extended state of a stick body 2 prior to landing, and FIG. 10(*b*) shows the contracted state of the stick body 2 upon landing.

DETAILED DESCRIPTION OF THE INVENTION

An embodiment of the present invention will be described in detail with reference to the accompanying drawings.

Figure 1:
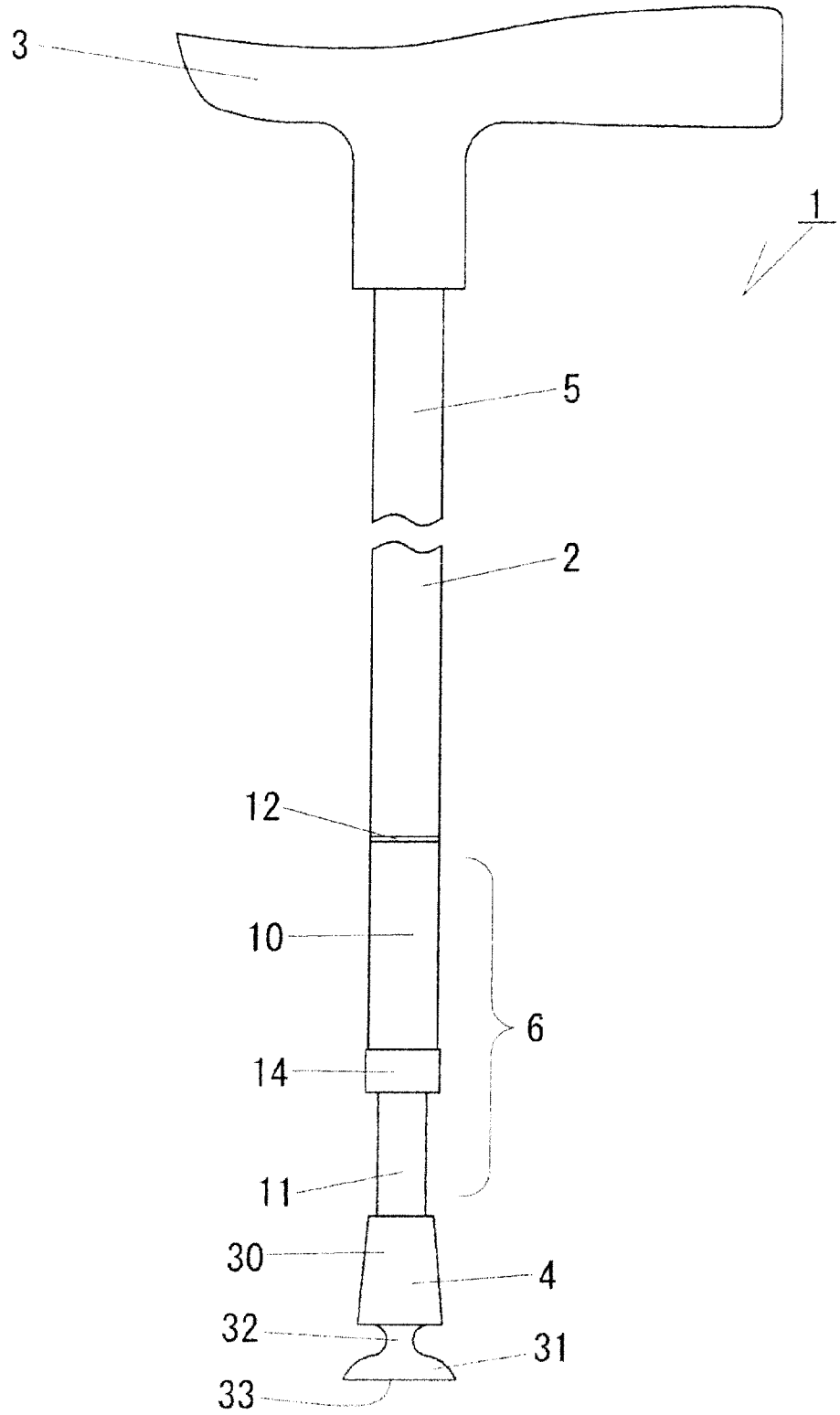
FIG. 1 is a side view of a stick 1 according to an embodiment.

A stick 1 according to this embodiment is used as an everyday walking aid for the elderly, physically handicapped, etc. As shown in FIG. 1, the stick 1 includes a stick body 2 having a rod-like shape, a T-shaped grip 3 provided at the top end of the stick body 2, and a shoe 4 provided at the bottom end of the stick body 2.

Figure 2:
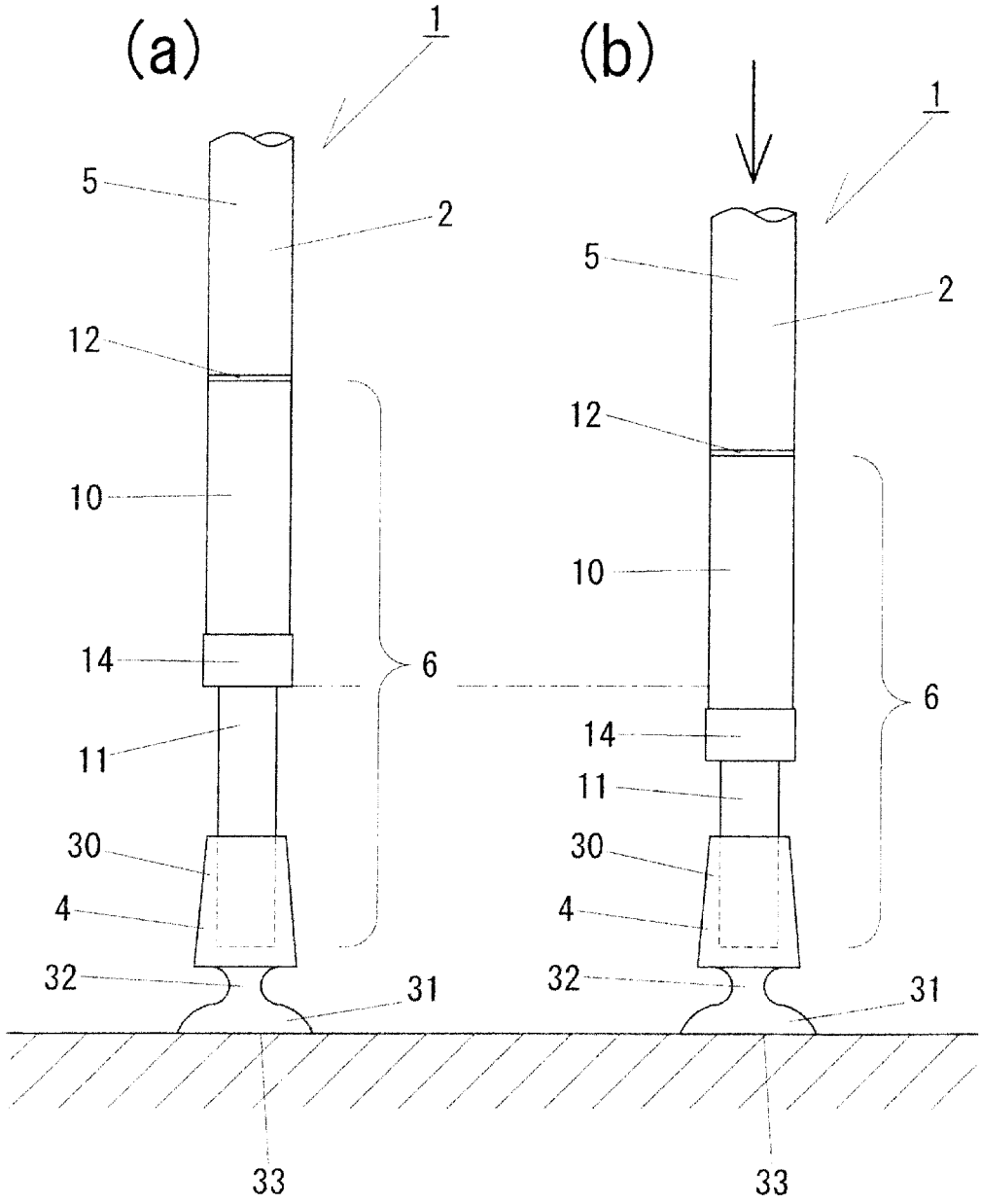
FIG. 2 is an enlarged view of the lower part of the stick 1.

The stick body 2 includes a long main pipe member 5 made of a metal pipe, and an extension pipe 6 coupled to the bottom end of the main pipe member 5. As shown in FIG. 2, the extension pipe 6 is of a telescopic type that is formed by fitting two metal pipes, an outer tube 10 and an inner tube 11, together in a nesting manner. The extension pipe 6 is threaded onto the bottom end of the main pipe member 5 via a connecting fitting 12 mounted at the top end of the outer tube 10. The shoe 4 is mounted at the bottom end of the inner tube 11. Specifically, the outer tube 10 is a metal pipe having the same diameter as the main pipe member 5, and the inner tube 11 is a metal pipe having a diameter smaller than the outer tube 10. As the inner tube 11 fits from bottom end into the outer tube 10 and slides with respect to the outer tube 10, the extension pipe 6 extends and contracts. The inner tube 11 is undetachably locked in position with respect to the outer tube 10 by means of a cylindrical locking fitting 14 that is threaded onto the bottom end of the outer tube 10. As described later, the extension pipe 6 is urged so as to extend by a shock absorber, and as shown in FIG. 2, the extension pipe 6 contracts when a load is applied to the stick 1.

Figure 3:
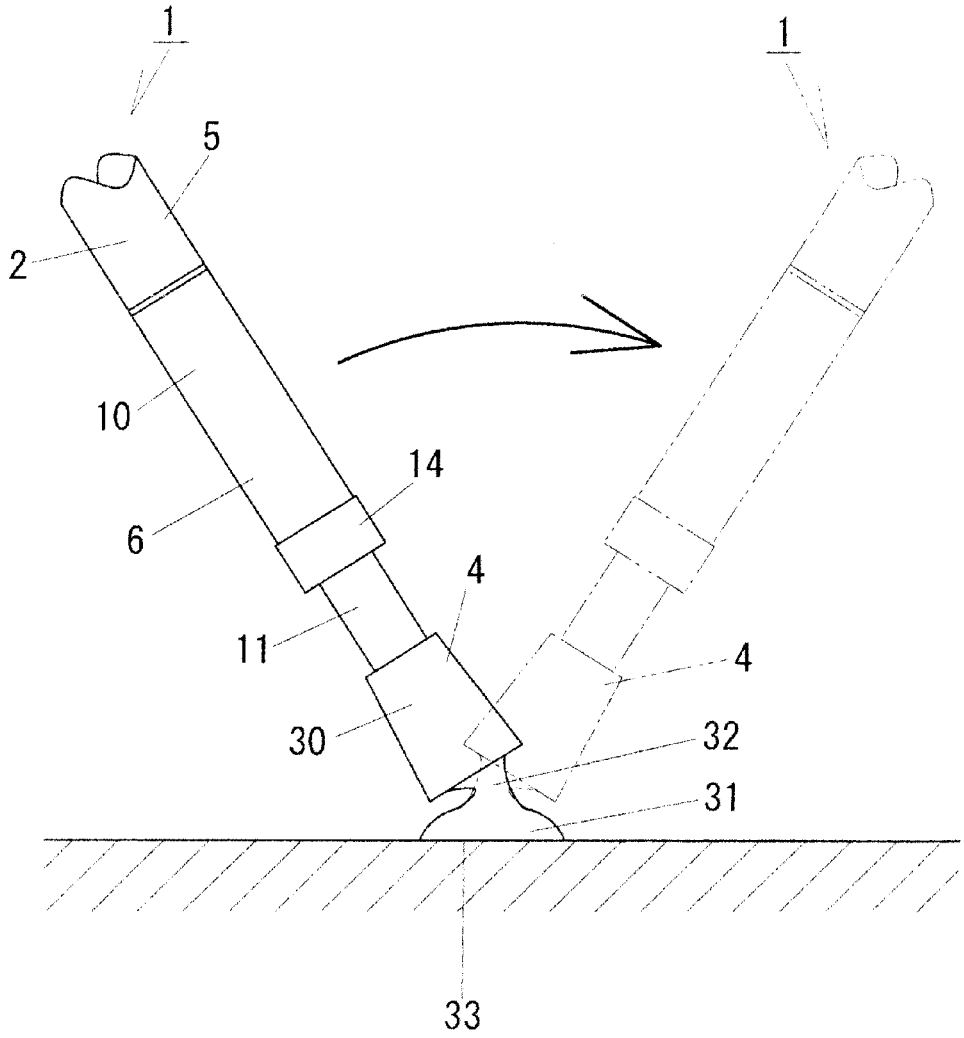
FIG. 3 is an explanatory view showing the function of a shoe 4.

As shown in FIGS. 1 and 2, the shoe 4 is a rubber member formed by integrally coupling a fitting part 30 that tightly fits to the bottom end of the inner tube 11, and a grounding part 31 having a bottom surface 33 provided with a non-slip shape, by a flexible neck part 32. As shown in FIG. 3, as the neck part 32 bends with the shock or load upon landing on the ground, the shoe 4 described above can keep the bottom surface 33 of the grounding part 31 placed on the ground even when the stick 1 is tilted. Therefore, according to the stick 1 in this embodiment, the bottom surface 33 having a non-slip shape is kept in contact with the ground until the stick 1 is released after being placed on the ground, thereby securely fixing the tip of the stick 1 to the ground.

Hereinafter, configuration related to the major features of the present invention is described.

Figure 4:
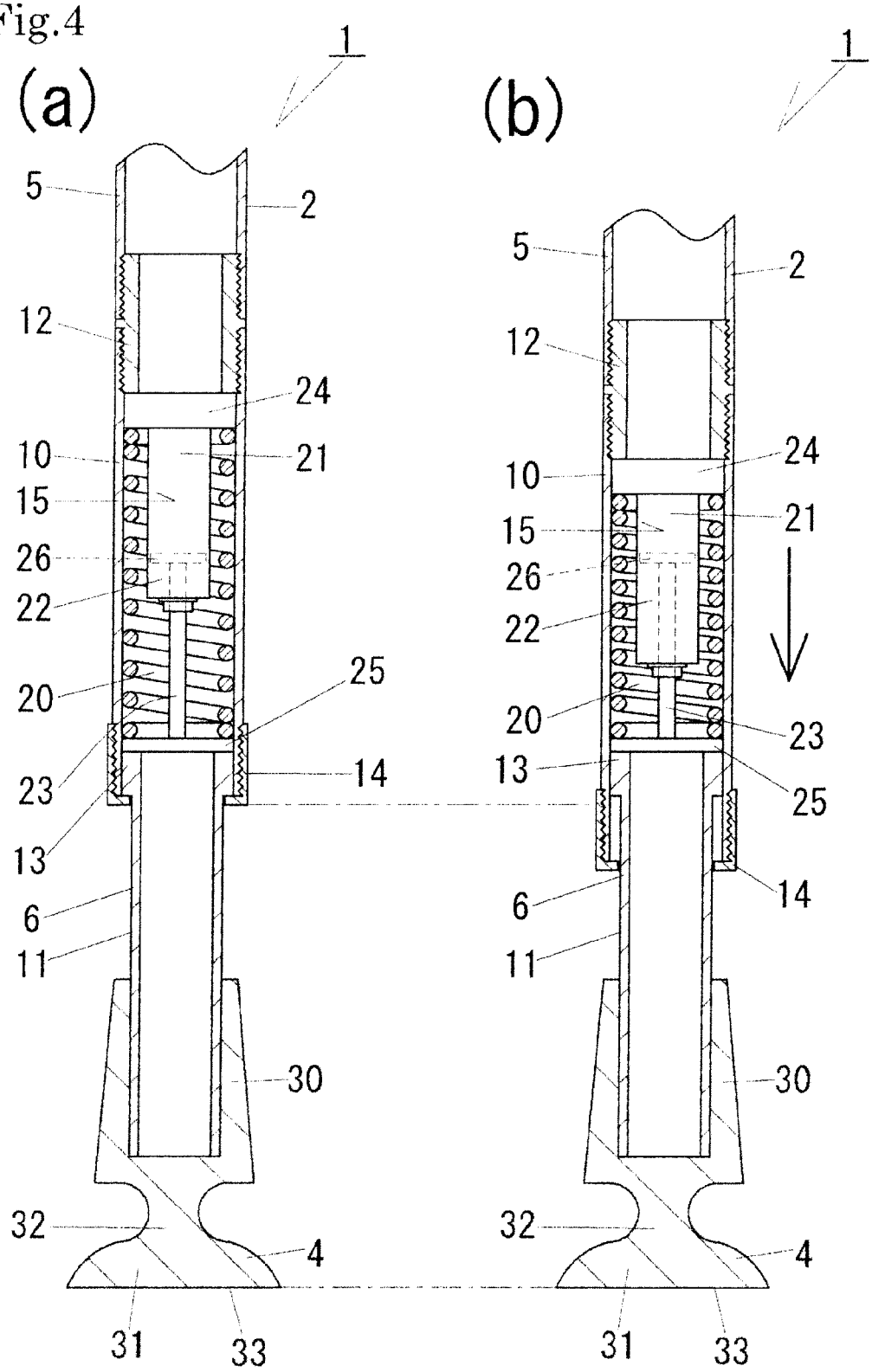
FIG. 4 is an enlarged longitudinal sectional view of the lower part of the stick 1.
Figure 5:
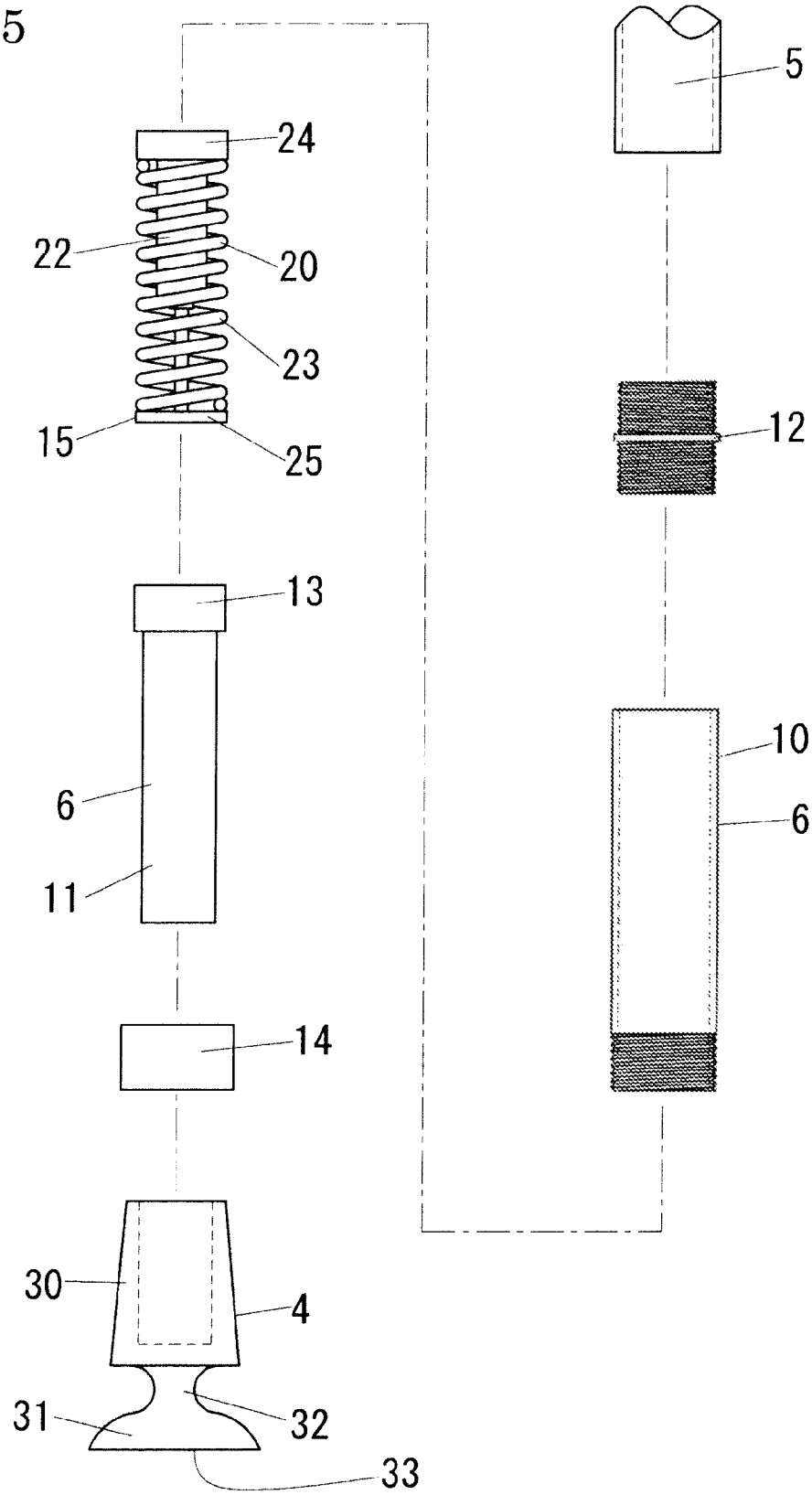
FIG. 5 is an exploded view of the lower part of the stick 1.

In the extension pipe 6, as shown in FIGS. 4 and 5, the inner tube 11 fits into the bottom end of the outer tube 10, and is held slidably with respect to the outer tube 10. Also, the inner tube 11 is undetachably locked in position with respect to the outer tube 10 by means of engagement between the cylindrical locking fitting 14 threaded onto the bottom end of the outer tube 10, and a locking part 13 provided so as to bulge from the periphery of the top end of the inner tube 11. A shock absorber 15 according to the present invention is stored in the outer tube 10. As the shock absorber 15 urges the inner tube 11 so as to push the inner tube 11 out of the outer tube 10, the extension pipe 6 is urged so as to extend, and is normally held in an extended state in which the locking part 13 and the locking fitting 14 engage with each other.

As shown in FIGS. 4 and 5, the shock absorber 15 is formed by installing the compression coil spring 20 and an oil damper 21 concentrically. The oil damper 21 is a common velocity-dependent damper including a cylinder 22 in which oil is filled, and a piston rod 23 that moves up and down against the viscosity of the oil. That is, the piston rod 23 penetrates the bottom end of the cylinder 22 and couples to a piston 26 inside the cylinder 22. Thus, the piston rod 23 is slidably held so as to project from and retract into the cylinder 22. Also, as the oil in the cylinder 22 hinders movement of the piston 26, a damping force acts in accordance with the speed at which the piston rod 23 travels so as to project and retract. Since a known oil damper can be suitably adopted for the oil damper 21, a detailed description of the oil damper 21 is omitted. Disk-shaped flanges 24 and 25 that protrude outwards are threaded onto the top end of the cylinder 22 of the oil damper 21, and the bottom end of the piston rod 23, respectively. The compression coil spring 20 has an inside diameter greater than the body part of the oil damper 21 and smaller than the flanges 24 and 25. The compression coil spring 20 elastically contacts the flanges 24 and 25 at its ends while concentrically fitting onto the body part of the oil damper 21.

As shown in FIG. 4, in the shock absorber 15, the compression coil sprig 20 is stored in the hollow of the outer tube 10 in a somewhat contracted state, with the flange 24 at the top end being in elastic contact with the connecting fitting 12 at the top end of the outer tube 10 and the flange 25 at the bottom end being in elastic contact with the top end of the inner tube 11. Thus, the compression coil spring 20 and the oil damper 21 are connected in parallel with respect to the outer tube 10 and the inner tube 11. When in such a storage state, the compression coil spring 20 urges the outer tube 10 upwards and the inner tube 11 downwards. As a result, the extension pipe 6 is normally held in an extended state as shown in FIG. 4(*a*).

Then, in the state with the extension pipe 6 extended, when a predetermined force is applied so as to contract the extension pipe 6, as shown in FIG. 4(*b*), the compression coil spring 20 further contracts, and the outer tube 10 and the inner tube 11 move relative to each other. Thus, the extension pipe 6 becomes contracted. At this time, the oil damper 21 exerts a damping action that suppresses the relative movement of the outer tube 10 and the inner tube 11. Consequently, the compression coil spring 20 hardly vibrates, and quickly converges to a length that is in proportion to the applied force.

According to the extension pipe 6 described above, when the user places the tip of the stick 1 on the ground while walking, the compression coil spring 20 of the shock absorber 15 contracts, and the shock on landing is converted into elastic energy of the compression coil spring 20, thereby mitigating the shock transmitted to the grip 3. Then, after landing, owing to the damping force of the oil damper, the compression coil spring 20 vibrates hardly, and stops at a length that is in proportion to the load applied to the grip 3, so the length of the stick 1 quickly becomes stable. Therefore, it is possible for the user to obtain stable support immediately after placing the stick 1 on the ground.

Once the length of the extension pipe 6 becomes stable after landing, even when the load applied to the grip 3 varies slightly, the damping action of the oil damper 21 keeps extension and contraction of the extension pipe 6 to the minimum, thereby keeping the length of the stick 1 stable. Then, as the tip of the stick 1 leaves the ground, the extension pipe 6 is returned to the extended state by the urging force of the compression coil spring 20.

In this way, according to the stick 1 in this embodiment, the shock on landing can be absorbed by the compression coil spring 20 of the shock absorber 15. Meanwhile, since the length of the extension pipe 6 quickly becomes stable after landing, it is possible for the user to obtain stable support immediately after landing.

Next, a modification is described in which the shock absorber is modified in configuration from the above-mentioned embodiment. Since the configuration of a stick 1*a* according to this modification other than the shock absorber is the same as that of the above-mentioned embodiment, a description in this regard is omitted by using the same reference numerals.

Figure 6:
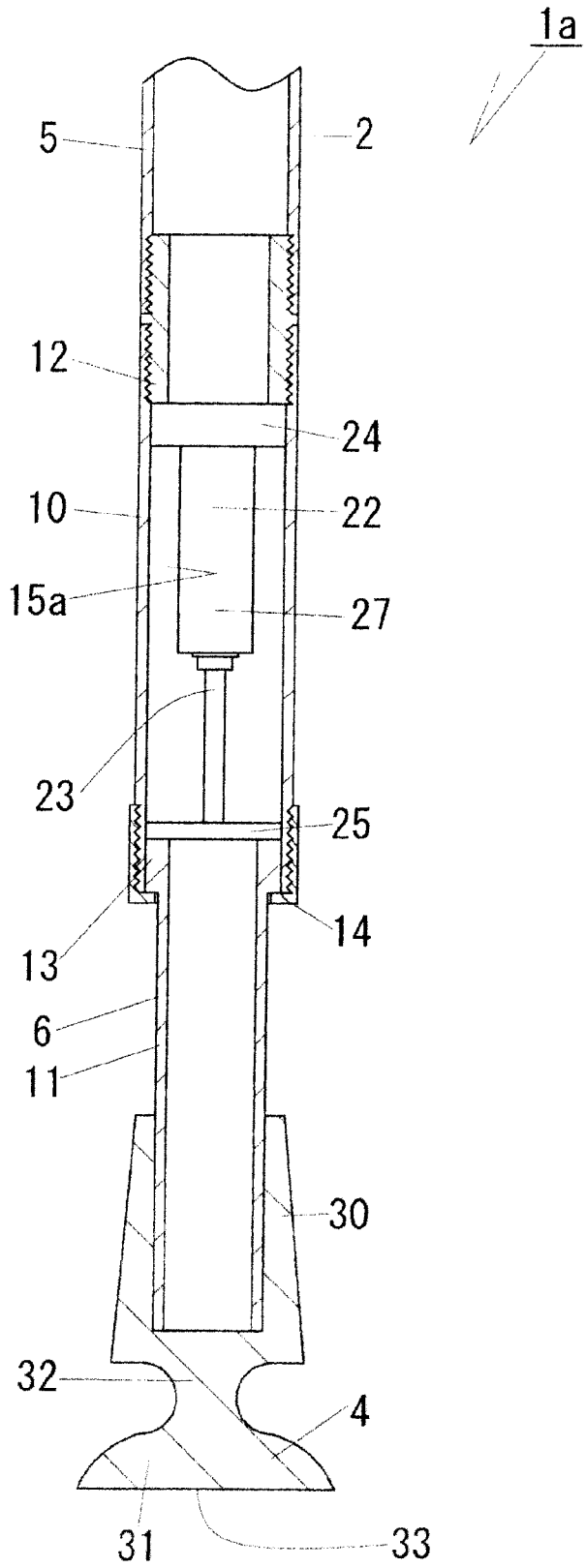
FIG. 6 is an enlarged longitudinal sectional view of the lower part of a stick 1*a* according to a modification.
Figure 7:
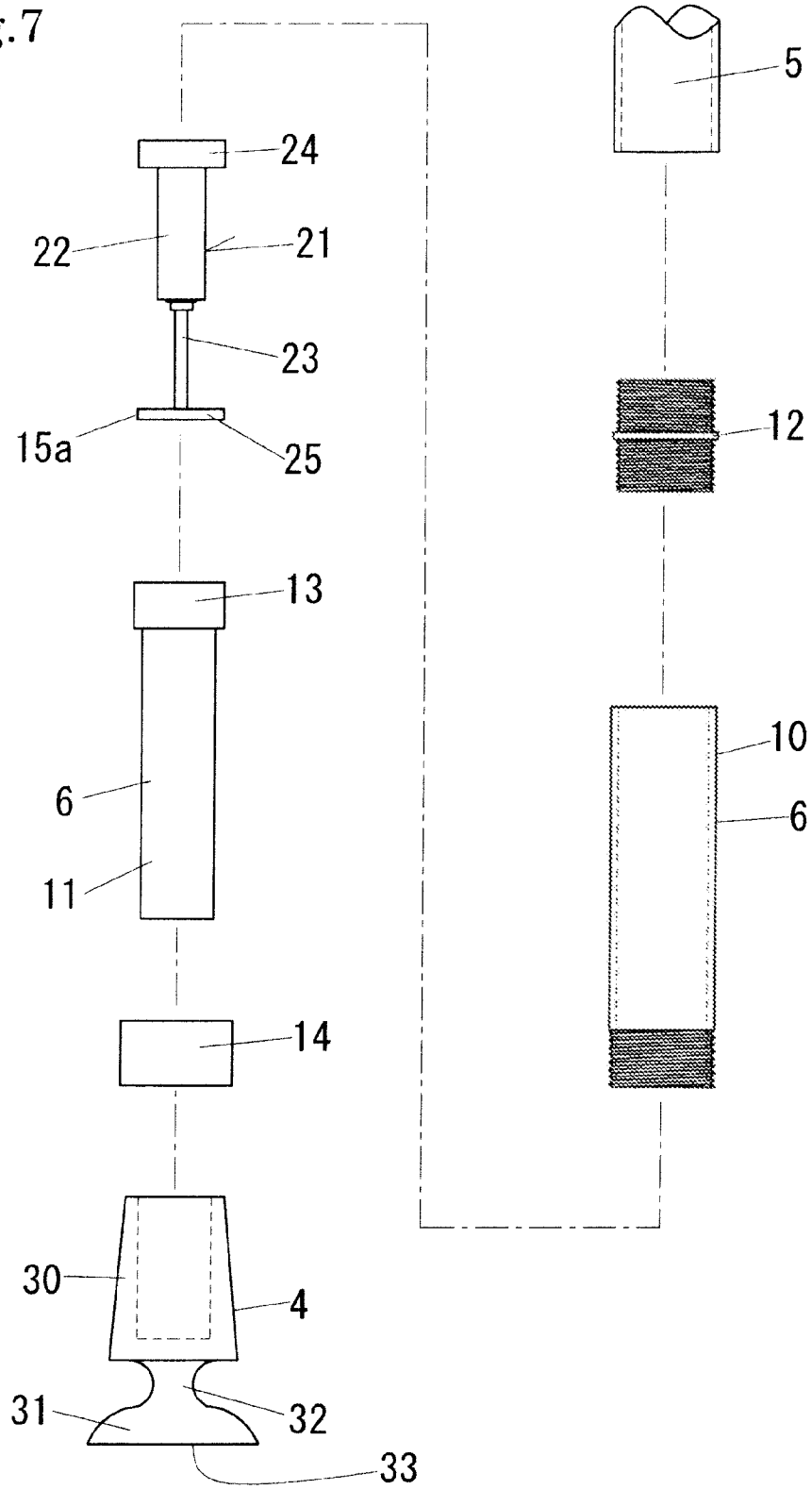
FIG. 7 is an exploded view of the lower part of the stick 1*a*.

As shown in FIGS. 6 and 7, in the stick 1*a* according to this modification, a shock absorber 15*a* built in the extension pipe 6 is configured solely by a gas-type damper 27. The gas-type damper 27 exerts a spring action and a velocity-dependent damping action simultaneously owing to the gas pressure in the cylinder 22.

Figure 8:
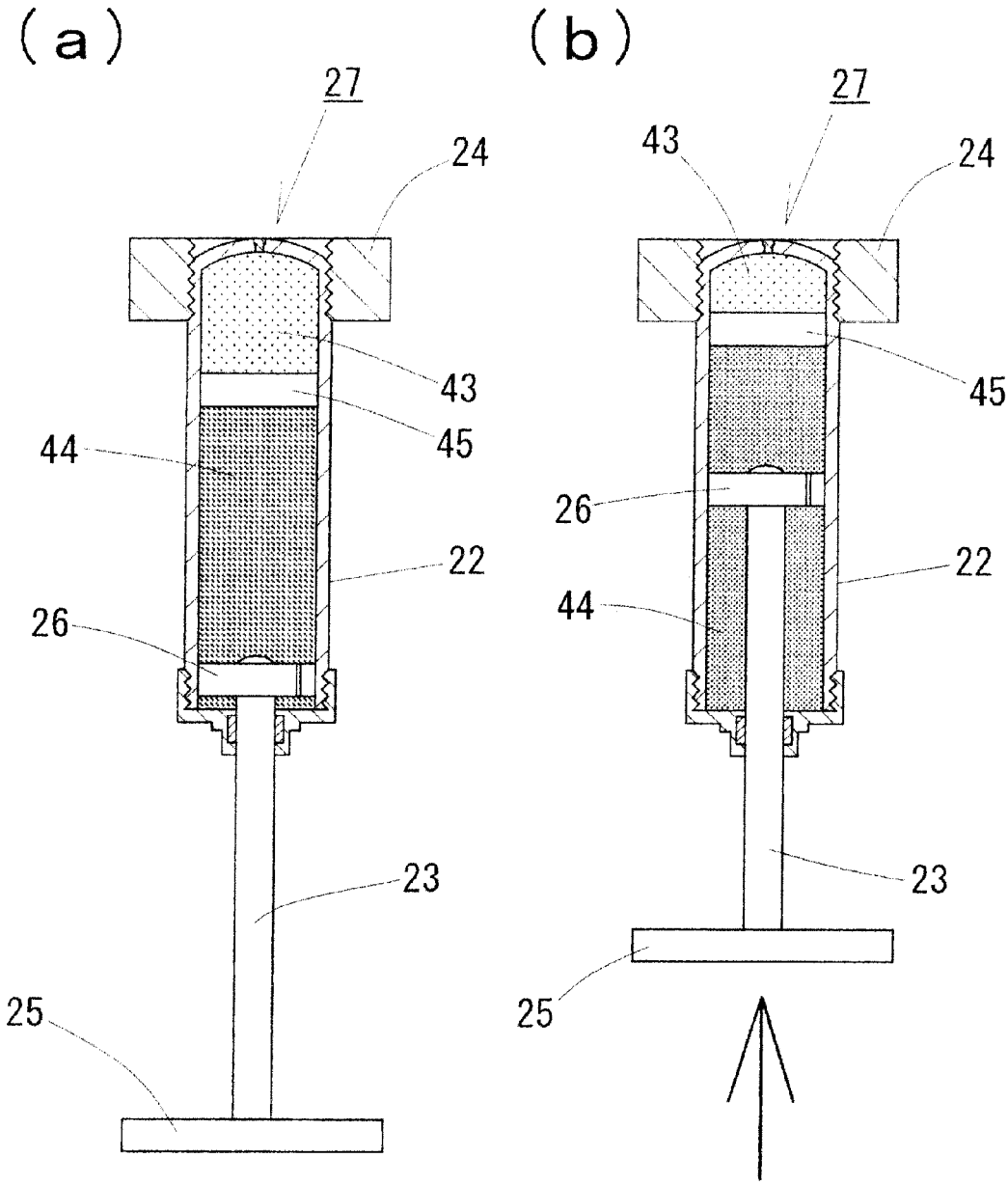
FIG. 8 is a longitudinal sectional view of a gas-type damper 27.

An example of the gas-type damper 27 used in this modification is as shown in FIG. 8. The gas-type damper 27 is made up of the cylinder 22 and the piston rod 23. The cylinder 22 includes a gas chamber 43 filled with compression gas, an oil chamber 44 filled with oil, and a free piston 45 that separates the gas chamber 43 and the oil chamber 44. The piston rod 23 penetrates the bottom end of the cylinder 22 and couples to the piston 26 inside the cylinder 22, so that the piston rod 23 is slidably held so as to project from and retract into the cylinder 22. In the gas-type damper 27 described above, as the oil hinders movement of the piston 26, a damping force corresponding to the speed of travelling acts in the direction in which the piston rod 23 projects and retracts, and as the piston 26 is pressed by the gas pressure of the compression gas, the piston rod 23 is urged so as to project. Since the gas-type damper 27 described above is of a common existing type, and a gas-type damper according to the present invention is not limited to the one shown in FIG. 8, a detailed description of such a gas-type damper is omitted.

As shown in FIGS. 6 to 8, the disk-shaped flanges 24 and 25 that protrude outwards are provided at the top end of the cylinder 22 of the gas-type damper 27, and the bottom end of the piston rod 23, respectively. The gas-type damper 27 is stored in the hollow of the outer tube 10 in a somewhat contracted state, with the flange 24 at the top end being in elastic contact with the connecting fitting 12 at the top end of the outer tube 10 and the flange 25 at the bottom end being in elastic contact with the top end of the inner tube 11. When in such a storage state, the spring force of the gas-type damper 27 urges the outer tube 10 upwards and the inner tube 11 downwards. As a result, as shown in FIG. 6, the extension pipe 6 is normally held in an extended state in which the locking part 13 and the locking fitting 14 engage with each other.

Then, in the state with the extension pipe 6 extended, when a predetermined force exceeding the resistance force of the gas-type damper 27 is applied, the outer tube 10 and the inner tube 11 move relative to each other so as to contract the expansion tube 6. Thus, the extension pipe 6 becomes contracted. At this time, the gas-type damper 27 exerts a damping action that suppresses the relative movement of the outer tube 10 and the inner tube 11. Consequently, the extension pipe 6 quickly converges to a length that is in proportion to the applied force.

According to the extension pipe 6 described above, when the user places the tip of the stick 1*a* on the ground while walking, the extension pipe 6 contracts with the gas-type damper 27 resisting the contracting force. Thus, the shock transmitted to the grip 3 is mitigated. Then, owing to the damping action of the gas-type damper 27, the extension pipe 6 that has contracted hardly vibrates and stops at a length that is in proportion to the load applied to the grip 3, so the length of the stick 1*a* quickly becomes stable. Therefore, according to the above-mentioned modification as well, it is possible for the user to obtain stable support immediately after placing the stick 1*a* on the ground.

Once the length of the extension pipe 6 becomes stable after landing, even when the load applied to the grip 3 varies slightly, the damping action of the gas-type damper 27 keeps extension and contraction of the extension pipe 6 to the minimum, thereby keeping the length of the stick 1*a* stable. Then, as the tip of the stick 1*a* leaves the ground, the extension pipe 6 is returned to the extended state by the spring force of the gas-type damper 27.

In this way, according to the stick 1 in this embodiment, solely by means of the gas-type damper 27, the shock on landing can be absorbed, and stable support can be obtained immediately after landing. When the shock absorber 15*a* is configured solely by the gas-type damper 27 in this way, the shock absorber can be made smaller than in the above-mentioned embodiment, thereby enabling further miniaturization and weight reduction of the stick.

Next, a modification is described in which the outer tube of the extension pipe is modified in configuration from the above-mentioned embodiment. Since the configuration of a stick 1*b* according to this modification other than the outer tube is the same as that of the above-mentioned embodiment, a description in this regard is omitted by using the same reference numerals.

Figure 9:
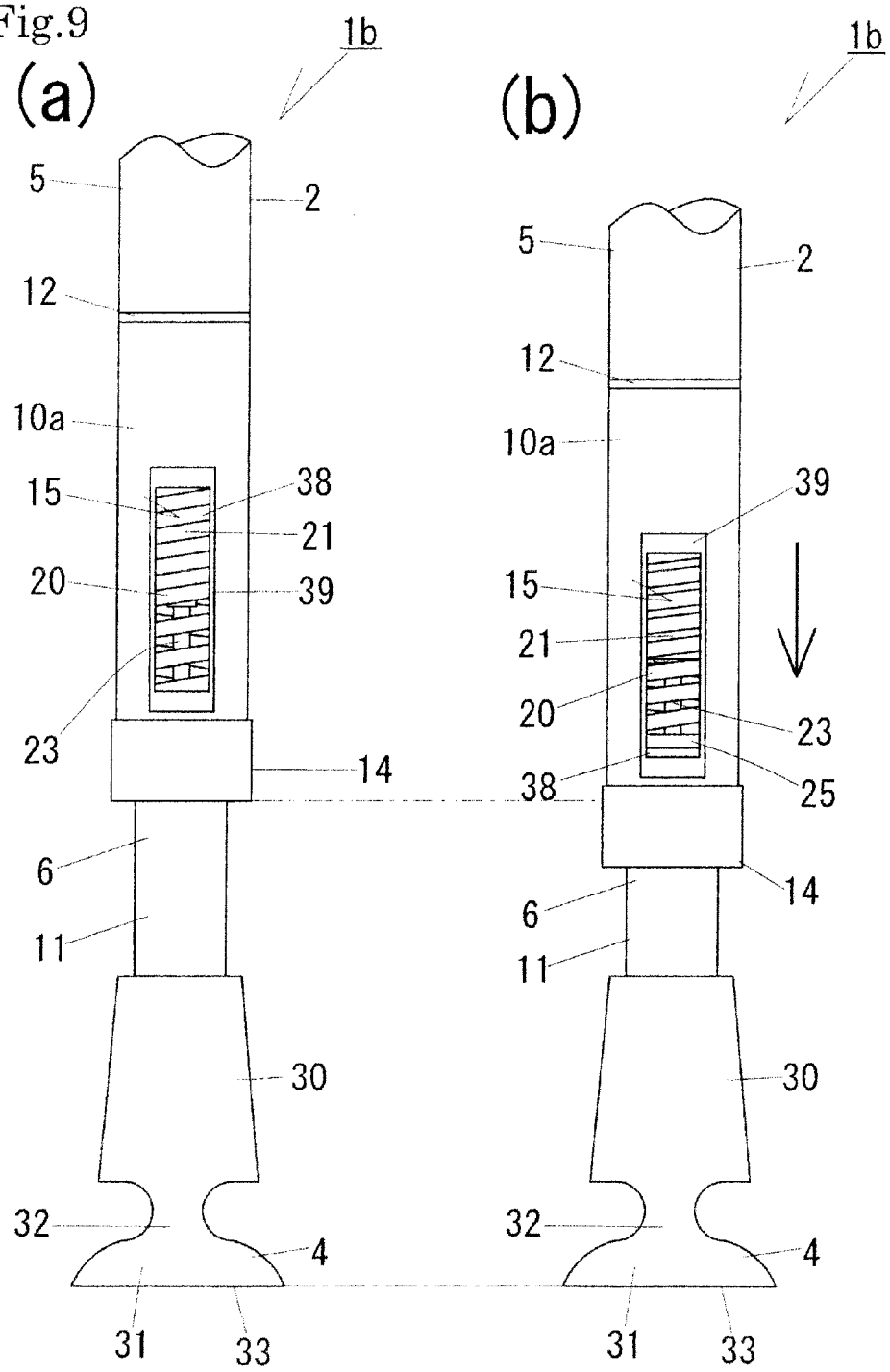
FIG. 9 is an enlarged view of the lower part of a stick 1*b* according to another modification.
Figure 10:
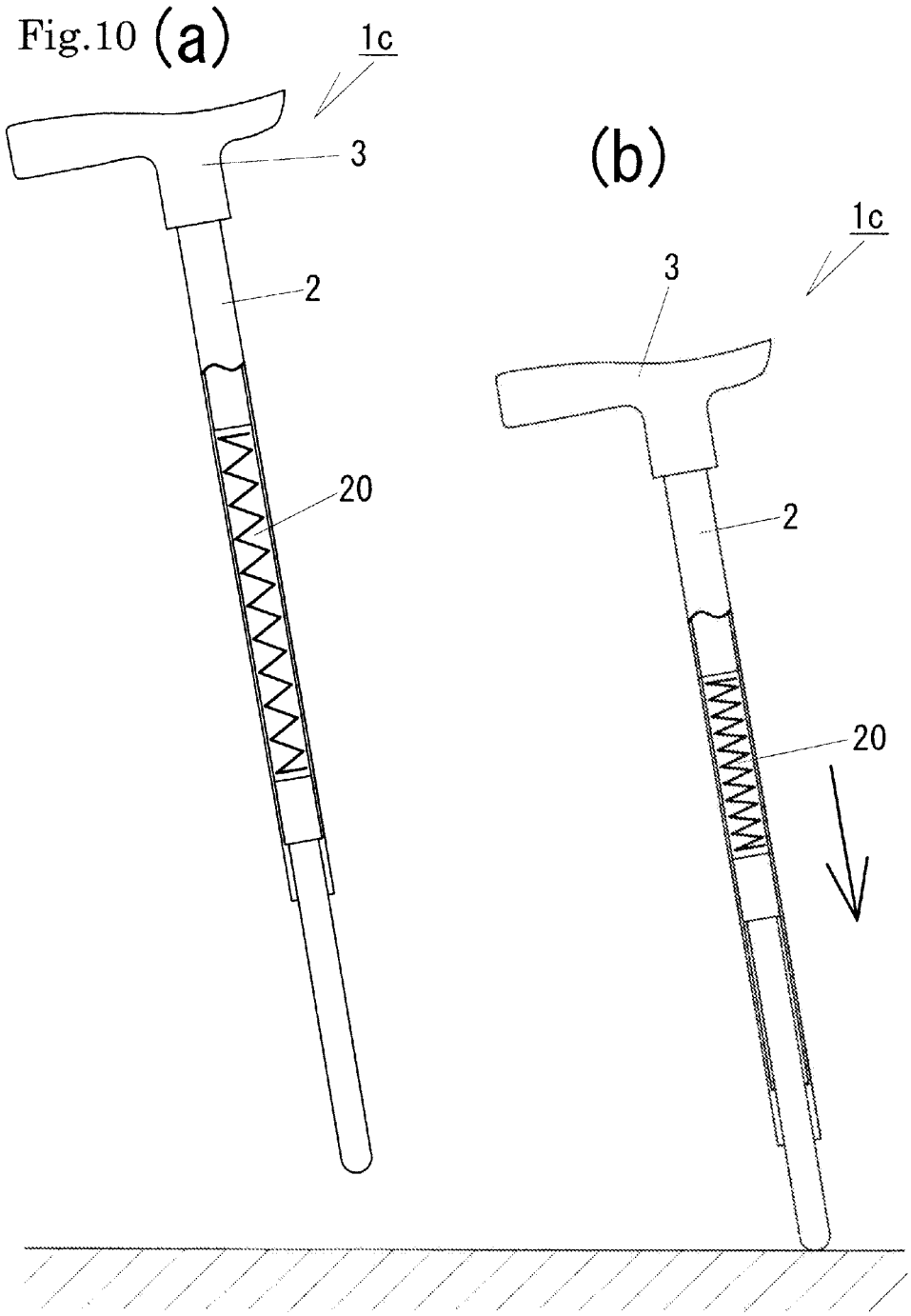
FIG. 10 is an explanatory view showing a stick 1*c* according to the related art.

In the stick 1*b* according to this modification, as shown in FIG. 9, a rectangular opening 38 is formed in the outer surface of a metal pipe forming an outer tube 10*a*, and the opening 38 is covered by a transparent plate 39 made of resin. When a part or the entirety of the outer tube 10 is replaced by a transparent material in this way, as shown in FIG. 9, it is possible for the user to view the way in which the compression coil spring 20 and the damper 21 extend and contact inside the extension pipe 6 from the outside via the opening 38.

The stick according to the present invention is not limited to the above embodiment but can be modified in various ways without departing from the scope of the present invention. For example, while in the embodiment the extension pipe is provided with a single damper and a single compression coil spring, the extension pipe may be provided with multiple dampers and compression coil springs. Also, the stick body may be provided with two or more extension pipes. In a case where the extension pipe is provided with an oil damper or a gas-type damper, it is also proposed to make the damping force of the damper adjustable in accordance with the weight of the user, or the like. The stick according to the present invention may be of a folding type or a knockdown type. While in the above embodiment the flanges 24 and 25 at the ends of the oil damper 21 are coupled to the outer tube 10 and the inner tube 11 by the urging force of the compression coil spring 20, the present invention is not limited to this configuration. The flanges 24 and 25 may alternatively be fixed to the outer tube 10 and the inner tube 11 with screws or the like provided additionally. While the stick 1 according to the above embodiment is used as an everyday walking aid, the present invention can be applied also to a stick used for mountain climbing, mountain hiking, or skiing by providing the stick with the extension pipe as in the above embodiment.

DESCRIPTION OF REFERENCE NUMERALS

1, 1*a*, 1*b*, 1*c*: stick
2: stick body
3: grip
4: shoe
5: main pipe member
6: extension pipe
10, 10*a*: outer tube
11: inner tube
12: connecting fitting
13: locking part
14: locking fitting
15, 15*a*: shock absorber
20: compression coil spring
21: oil damper
22: cylinder
23: piston rod
24, 25: flange
27: gas-type damper
30: fitting part
31: grounding part
32: neck part
33: bottom surface

What is claimed is:

1. A stick comprising:

a stick body of a rod-like shape that is provided with a grip, wherein:

the stick body includes an extension pipe of a telescopic type formed by fitting an outer tube and an inner tube together in a nesting manner;

inside the extension pipe, a compression spring that urges the extension pipe so as to be extended, and an oil damper having velocity dependence that damps a relative sliding movement between the outer tube and the inner tube are connected in parallel;

the oil damper includes a cylinder coupled to one of the outer tube and the inner tube, and a piston rod that is slidably held with respect to the cylinder and is coupled to the other one of the outer tube and the inner tube;

the cylinder and the piston rod each include a flange that protrudes outwards; and the compression spring is a compression coil spring having an inside diameter greater than a body part of the oil damper and smaller than the flanges of the cylinder and the piston rod, the compression coil spring elastically contacting at one end thereof the flange of the cylinder and elastically contacting at the other end thereof the flange of the piston rod while concentrically fitting onto the main part of the oil damper.

2. A stick comprising:

a stick body of a rod-like shape that is provided with a grip, wherein:

the stick body includes an extension pipe of a telescopic type formed by fitting an outer tube and an inner tube together in a nesting manner;

inside the extension pipe, a gas type damper having velocity dependence is provided, the gas type damper urging the extension pipe so as to be extended by a gas pressure and exerting a damping action with respect to a relative sliding movement between the outer tube and the inner tube;

the gas type damper includes a cylinder and a piston rod, a flange that protrudes outwards is further provided at each of an end of the cylinder and an end of the piston rod, and the gas type damper is stored in a hollow of the outer tube in a contracted state, with one of the flanges being in elastic contact with the outer tube side and the other flange being in elastic contact with a top end of the inner tube;

the cylinder is provided with a gas chamber filled with compression gas, an oil chamber tilled with oil, and a free piston that separates the gas chamber and the oil chamber; and the piston rod penetrates an end of the cylinder and is coupled to a piston held in the oil chamber, and is urged so as to project from the cylinder by a gas pressure of the compression gas, the piston rod having its travelling speed with respect to the cylinder reduced by viscosity of the oil in the oil chamber.

* * * * *